US006915086B2

(12) United States Patent
Huang

(10) Patent No.: US 6,915,086 B2
(45) Date of Patent: Jul. 5, 2005

(54) DEVICE FOR INCREASING THE DENSITY OF LASER PRINTS

(76) Inventor: Hilson Huang, P.O. Box No. 6-57, Chung-Ho, Taipei 235 (TW)

( * ) Notice: Subject to any disclaimer, the term of this patent is extended or adjusted under 35 U.S.C. 154(b) by 153 days.

(21) Appl. No.: 10/323,785

(22) Filed: Dec. 20, 2002

(65) Prior Publication Data

US 2003/0122916 A1 Jul. 3, 2003

(30) Foreign Application Priority Data

Dec. 30, 2001 (CN) ..... 01276417 U

(51) Int. Cl.[7] ..... G03G 15/01
(52) U.S. Cl. ..... 399/49; 400/693
(58) Field of Search ..... 399/49; 430/120, 430/126, 117–119; 428/143, 141; 400/88, 693, 691

(56) References Cited

U.S. PATENT DOCUMENTS 5,020,471 A * 6/1991 Yoshikai ..... 399/230
5,236,265 A * 8/1993 Saito et al. ..... 400/88
5,267,800 A * 12/1993 Petteruti et al. ..... 400/88
5,740,507 A * 4/1998 Ichikawa et al. ..... 399/262
6,343,200 B1 * 1/2002 Hatano et al. ..... 399/254
6,603,934 B2 * 8/2003 Shimmura ..... 399/49

* cited by examiner

*Primary Examiner*—Anthony H. Nguyen
(74) *Attorney, Agent, or Firm*—Troxell Law Office PLLC

(57) ABSTRACT

A device for increasing the image density of laser prints includes a machine, a rolling mechanism and a driving mechanism; wherein the machine is disposed with a paper inlet and a paper outlet; the rolling mechanism and the driving mechanism are disposed inside the machine; a processing tank for darkening the toner is disposed at the lower aspect of the rolling mechanism inside the machine; some solvent of the prior art is placed inside the processing tank for darkening the toner; a sheet of tracing paper is fed into the area of the paper inlet; the toner darkening solvent contacts the paper and darkens image areas covered by the toner along the rolling of the lower rolling shaft. Then, the darkened tracing paper is sent out from the paper outlet, after drying, which works directly as a film for exposing the plate during plate making in order for printing.

4 Claims, 2 Drawing Sheets

DEVICE FOR INCREASING THE DENSITY OF LASER PRINTS

BACKGROUND OF THE INVENTION

1) Field of the Invention

The present invention relates to a printing mechanism, more particularly, to a device for increasing the density of all kinds of laser prints.

2) Description of the Prior Art

In the procedure of a plate making for printing, it is necessary to make typesetting and image of an original into a film. However, the black color from the existing laser printer is not dark enough due to the quality of printer and toner, thereby fail to make a plate for printing. Therefore, either the conventional technique using a reproduction camera or the contemporary way adapts an exclusive computer—image setter—to output a positive or negative film in order for plate making.(For exposing images to the printing plate.)

SUMMARY OF THE INVENTION

The present invention aims to solve the problems of necessarily making a typesetting and image into a film first, in the procedure of a plate making, not having dark enough density on the image area printed by laser printer due to the quality of a printer and quantity of the toner, thereby fail to make a plate for printing. Although the contemporary technique using an image setter to output a film for plate making is getting common, but the price of an image setter is quite expensive. It may be necessary for a printing work to purchase an image setter for making their own film or rely on a trade house to output the film for them, in order to make plates for printing, but it is really too expensive and the material cost of this special film is also very high. And if by the conventional way, end usershave to invest much more on a reproduction camera and a film processor, most of them need a skillful technician. To solve the said prior art problems, the present invention provides a device for increasing the density of laser prints from a personnel computer, comprising a machine, a rolling mechanism and a driving mechanism; wherein a paper inlet and a paper outlet are disposed on said machine; a processing tank for darkening the toner of a laser print is disposed at the lower aspect of said rolling mechanism and said driving mechanism inside the machine; some solvent used by the prior art for darkening the toner is placed inside said processing tank; furthermore, a refill tank connects onto said processing tank for darkening the toner; one end of said refill tank is disposed on an outer lateral side of said machine thereby facilitating a user to refill said solvent from outside of the device. Said rolling mechanism comprises an upper rolling shaft and a lower rolling shaft; wherein, said upper rolling shaft is made of soft material while said lower rolling shaft is made of rigid material; two ends of said upper and lower rolling shafts are respectively disposed inside shaft holes on two lateral plates; said two lateral plates fix said machine via bolts; one part of said lower shaft immerses in said processing tank for darkening the toner; said rolling mechanism connects with said driving mechanism. Said driving mechanism comprises an electric motor, a driving gear and a driven gear; said electric motor drives said driving gear which further drives said driven gear; the rotating direction of said driving gear opposites that of the driven gear; said driving gear and said driven gear respectively and fixedly connect with one of said upper and lower rolling shafts in said rolling mechanism. When said driving mechanism works, a sheet of paper rolls through between said upper and lower rolling shafts; said solvent inside said processing tank for darkening the toner conducts the darkening procedure. Said machine comprises a front case and a rear case; said two cases fix together via bolts; said paper inlet is disposed on said front case; said paper outlet is disposed on said rear case; an electric on-and-off switch is disposed on said machine. The working procedure of the present invention is that, after image area are printed onto the translucent tracing paper from a laser printer, the tracing paper is fed through the device of the present invention for darkening the toner of the image area; said tracing paper is placed in said paper inlet area; activating said on-and-off switch makes said driving mechanism drive said upper and lower rolling shafts to rotate. At this time, said two rolling shafts roll the sheet of paper located in said paper inlet area into said machine. Since some part of said lower rolling shaft immerses inside said processing tank for darkening the toner, said toner darkening solvent contacts the paper and darkens image area covered by the toner along the rolling of said lower rolling shaft; then the image darkened tracing paper is sent out from said paper outlet, after drying it which works directly as a film ready for plate printing. The present invention corresponds to the prior art. Since said processing tank for darkening the toner is disposed at the lower aspect of said rolling mechanism, the present invention utilizes the solvent used by the prior art for darkening the toner to darken the image area directly and evenly on said tracing paper thereby solving the problem of having uneven darkening result obtained in the traditional darkening operation by hand painting or by spray, and saving the expenses for film and other auxiliary equipment; in addition, said device for increasing the density of laser prints is easy, economic and convenient to operate by an average person.

To enable a further understanding of achieving the above mentioned objectives and effectivenesses, the technical contents of the present invention is described by the brief description of the drawings and the detailed description of a preferred embodiment.

DETAILED DESCRIPTION OF THE PREFERRED EMBODIMENTS

Figure 1:
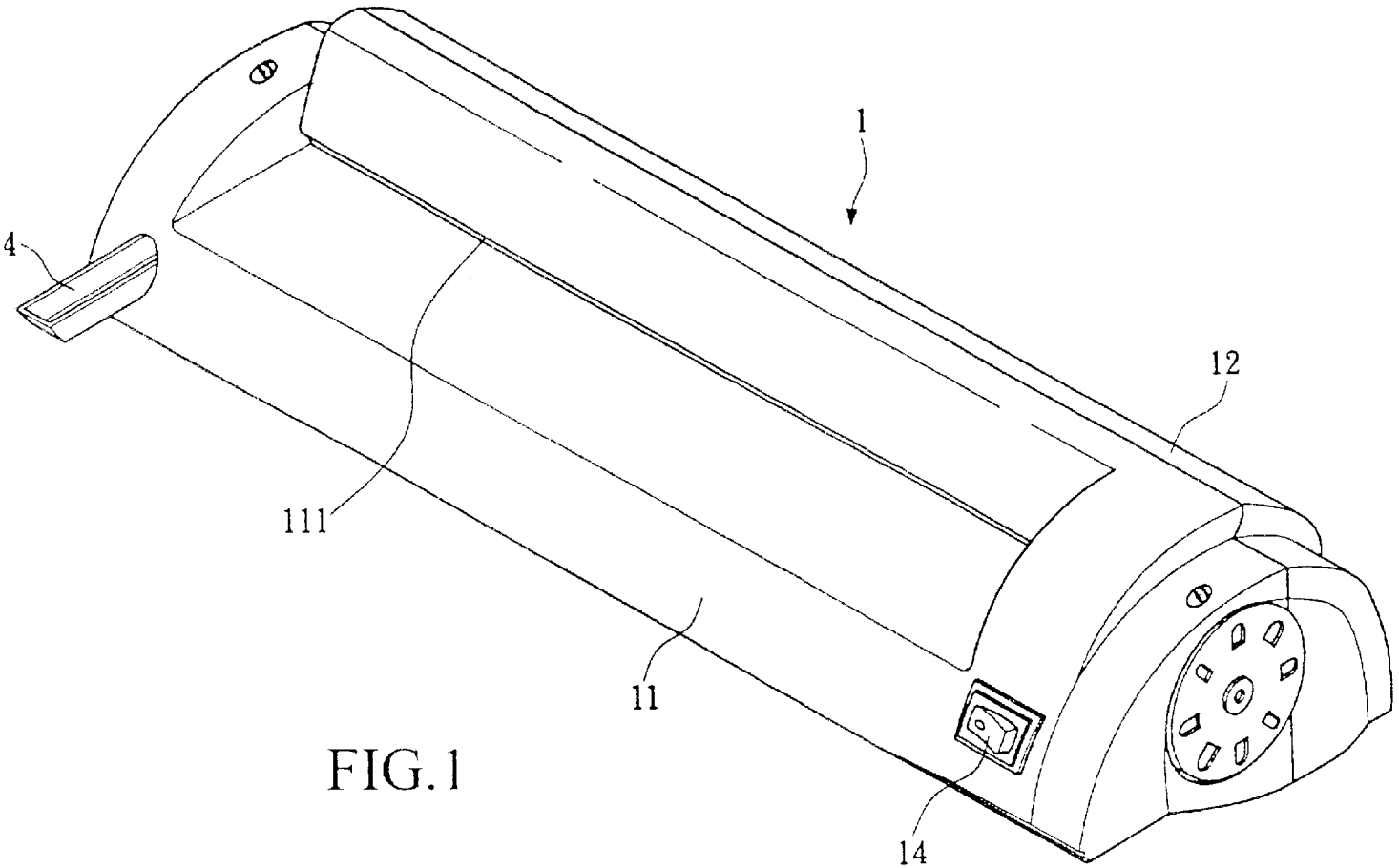
FIG. 1 is a schematic drawing of the present invention of a device for increasing the density of laser prints.
Figure 2:
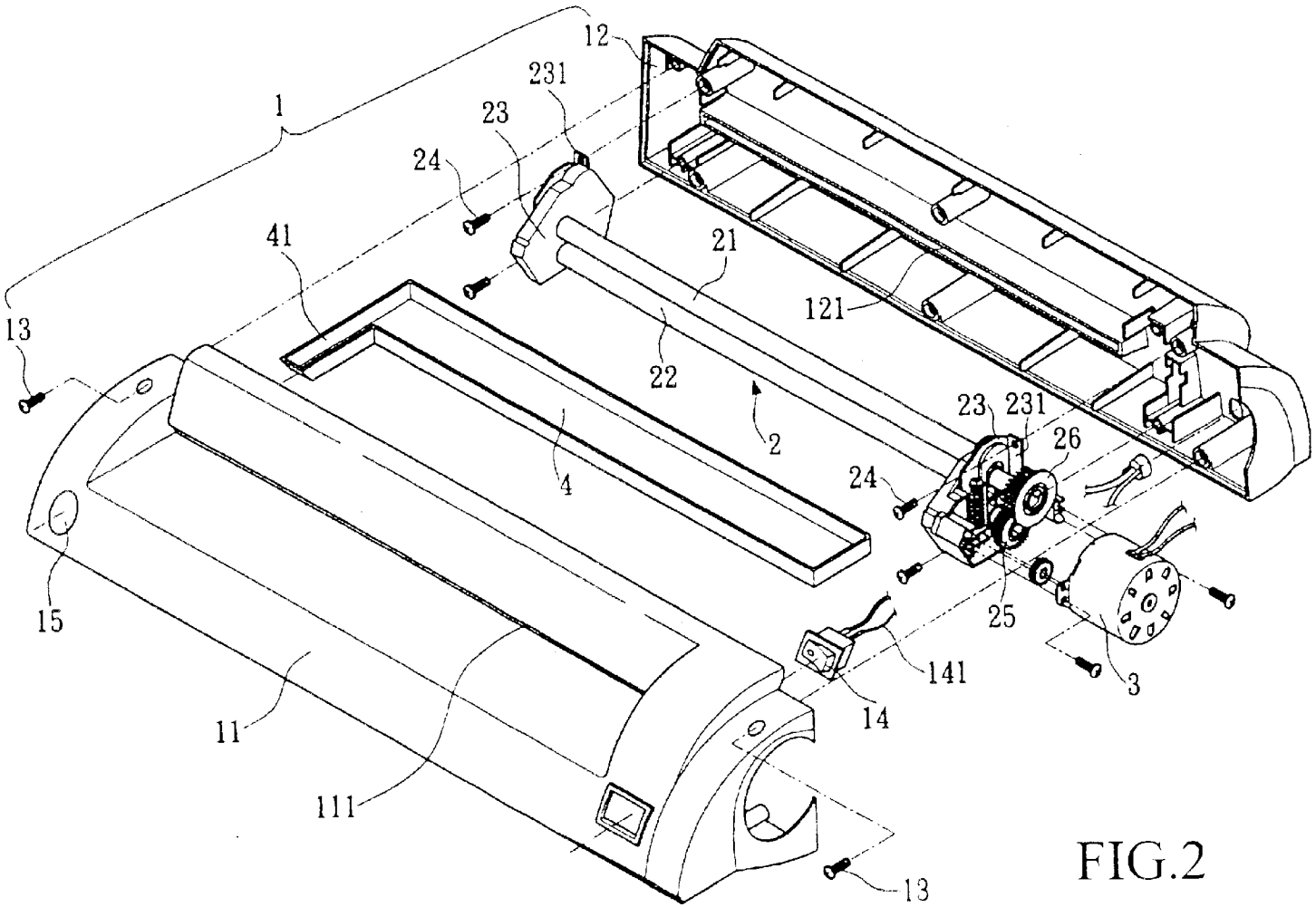
FIG. 2 is an explored and schematic drawing of the present invention of the device for increasing the density of laser prints.

As indicated in FIGS. 1 and 2, the present invention of a device for increasing the density of laser prints comprises a machine (1), a rolling mechanism (2) and a driving mechanism (3); wherein a paper inlet (111) and a paper outlet (121) are disposed on said machine (1); a processing tank (4) for darkening the toner is disposed at the lower aspect of said rolling mechanism (2) and said driving mechanism (3) inside said machine (1); some solvent used by the prior art for darkening the toner is placed inside said processing tank (4), furthermore, a refill tank (41) connects onto said processing tank (4) for darkening the toner; one end of said refill tank (41) is disposed on an outlet lateral side of said machine (1) thereby facilitating a user to refill said solvent. Said rolling mechanism (2) comprises an upper rolling shaft (21) and a lower rolling shaft (22); wherein, said upper rolling shaft (21) is made of soft material while said lower rolling shaft (22) is made of rigid material; two ends of said upper and lower rolling shafts (21, 22) are respectively disposed inside shaft holes on two lateral plates (23); said two lateral plates (23) fix said machine (1) via bolts (24); a part of said lower shaft (22) immerses in said processing tank (4) for darkening the toner; said rolling mechanism (2) connects with said driving mechanism (3). Said driving mechanism (3) comprises an electric motor, a driving gear (25) and a driven gear (26); said electric motor drives said driving gear (25) which further drives said driven gear (26); the rotating direction of said driving gear (25) opposites that of the driven gear (26); said driving gear (25) and said driven gear (26) respectively and fixedly connect with one of said upper and lower rolling shafts (21, 22) in said rolling mechanism (2). When said driving mechanism (25) works, a sheet of paper rolls through between said upper and lower rolling shafts (21, 22); said solvent inside said processing tank (4) for darkening the toiler conducts the darkening procedure. Said machine (1) comprises a front case (11) and a real case (12); said two cases (11, 12) fix together via bolts (13); said paper inlet (111) is disposed on said front case (11); said paper outlet (121) is disposed on said rear case (12); an electric on-and-off switch (14) is disposed on said machine (1). The working procedure of the present invention is that after image area are printed onto the tracing paper via laser printer, the tracing paper is fed into the inlet (111) area of the device of the present invention for darkening the toner; activating said on-and-off switch (14) makes said driving mechanism (3) to drive said upper and lower rolling shafts (21, 22) to rotate. At this time, said two rolling shafts (21, 22) roll the sheet of paper located in said paper inlet (111) area into said machine (1). Since one part or said lower rolling shaft (22) immerses inside said processing tank (4) for darkening the toner, said toner darkening solvent contacts the paper and darkens image areas covered by the toner along the rolling of said lower rolling shaft (22); then the darkened tracing paper is sent out from said paper outlet (121), after drying it, which works directly as a film ready for plate making. The present invention corresponds to the prior art. Since said processing tank (4) for darkening the toner is disposed at the lower aspect of said rolling mechanism (2), the present invention utilizes some solvent which used by the prior art for darkening the toner to darken the image areas on said tracing paper directly and evenly, which method is not just solving the problem of having uneven darkening result obtained by the traditional darkening operation by hand or spray, also saving from investing expensive film and other auxiliary equipment; in addition, said device for increasing the density of laser prints is easy, economic and convenient to operate.

Of course, it could be understood that the described embodiment herein is merely illustrative of the principles of the invention and that is a wide variety of modifications thereto may be effected by skilled persons in the art without departing from the spirit and scope of the invention as set forth in the following claims.

What is claimed is:

1. A device for increasing a density of laser prints comprising:

a) a housing having a paper inlet and a paper outlet;

b) a rolling mechanism located in an interior of the housing;

c) a driving mechanism located in the interior of the housing; and d) a processing tank containing solvent for darkening a toner and increasing the density of laser prints and including a refill tank with one end disposed on an outer lateral side of the housing.

2. The device according to claim 1, wherein the housing includes a front casing and a rear casing connected to the front casing, the paper inlet is located on the front casing and the paper outlet is located on the rear casing.

3. The device according to claim 1, further comprising an electric switch located on the housing.

4. The device according to claim 1, wherein the rolling mechanism includes an upper rolling shaft, a lower rolling shaft and two lateral plates connected to the interior of the housing, the upper shaft and the lower shaft being rotatably connected between the two lateral plates at opposing ends thereof, the driving mechanism includes an electric motor, a driving gear driven by the electric motor and a driven gear driven by the driving gear; the rolling mechanism is connected to the driving mechanism.

* * * * *